US009995029B2

(12) United States Patent
Matsuo et al.

(10) Patent No.: US 9,995,029 B2
(45) Date of Patent: Jun. 12, 2018

(54) FLUSH TOILET HAVING RIM SLOT OF VARYING WIDTH

(71) Applicant: TOTO LTD., Kitakyushu-shi, Fukuoka (JP)

(72) Inventors: Naoto Matsuo, Kitakyushu (JP); Eiji Shiohara, Kitakyushu (JP); Masaki Kitamura, Kitakyushu (JP); Masaaki Inoue, Kitakyushu (JP)

(73) Assignee: TOTO LTD., Kitakyushu-shi, Fukuoka (JP)

( * ) Notice: Subject to any disclaimer, the term of this patent is extended or adjusted under 35 U.S.C. 154(b) by 1 day.

(21) Appl. No.: 15/221,280

(22) Filed: Jul. 27, 2016

(65) Prior Publication Data

US 2017/0044751 A1 Feb. 16, 2017

(30) Foreign Application Priority Data

Aug. 10, 2015 (JP) ..... 2015-158253

(51) Int. Cl.
*E03D 11/08* (2006.01)

(52) U.S. Cl.
CPC ..... *E03D 11/08* (2013.01)

(58) Field of Classification Search
CPC ..... E03D 11/02; E03D 11/04; E03D 11/06; E03D 11/08
USPC ..... 4/420, 421, 429, 430
See application file for complete search history.

(56) References Cited

U.S. PATENT DOCUMENTS 4,130,907 A * 12/1978 Flegel ..... E03D 11/04 4/300
7,661,153 B2 * 2/2010 Nakamura ..... E03D 11/08 4/420
8,667,620 B2 * 3/2014 Mueller ..... E03D 11/08 4/420
8,695,126 B2 * 4/2014 Yoneda ..... E03D 11/08 4/420

(Continued)

FOREIGN PATENT DOCUMENTS

DE 2403139 A1 * 7/1975 ..... E03D 11/02
FR 2744744 A1 * 8/1997 ..... E03D 11/08
JP 4062731 B2 3/2008

OTHER PUBLICATIONS

Machine Translation of DE '139.*

*Primary Examiner* — Erin Deery
(74) *Attorney, Agent, or Firm* — Baker & Hostetler LLP

(57) ABSTRACT

To provide a flush toilet in which: a circulating flow can be formed to uniformly circulate over a waste receiving surface while flushing; localized changes in external appearance of a toilet main body can be inhibited; and impression of a left-right symmetrical external shape can be conveyed to users so that design characteristics thereof are favorably preserved. A rim portion in a flush toilet includes a slit opening portion formed between an upper edge portion of the waste receiving surface formed to be left-right asymmetrical and a rim inside wall formed to be left-right symmetrical. The slit opening portion is formed such that a slit gap on one side, to which a connecting water conduit is directed, is smaller than a slit gap on the other side. A circulating flow is formed on the waste-receiving surface by flush water spouted from the slit opening portion having the different slit gaps.

13 Claims, 6 Drawing Sheets

(56) References Cited

U.S. PATENT DOCUMENTS

| | | | | |
|---|---|---|---|---|
| 9,518,384 | B2 * | 12/2016 | Kashirajima | E03D 11/02 |
| 2005/0166308 | A1 * | 8/2005 | Miwa | E03D 11/02 4/420 |

* cited by examiner

FLUSH TOILET HAVING RIM SLOT OF VARYING WIDTH

TECHNICAL FIELD

The present invention pertains to a flush toilet, and more particularly to a flush toilet for flushing a toilet main body with flush water.

BACKGROUND ART

For some time toilets comprising an open rim structure have been known, wherein a conventional flush toilet 101 such as the one shown in FIG. 7 comprises a slit opening 134 on a bottom surface of a rim passage 120 in a rim 118 formed over the entire circumference of a toilet main body 102. In this type of open rim structure, flush water supplied from a supply port 106 is supplied from a rim rear water conduit 110 to the rim passage 120, then spouted from the rim passage 120 onto a waste receiving surface 116 through the slit opening 134. The flush toilet 101 with this type of open rim structure has the advantage that it can be manufactured relatively inexpensively but is also subject to the problems described below.

In a conventional flush toilet open rim structure such as that shown, for example, in Patent Document 1 (Japanese Patent No. 4062731), an inside end of a shelf portion in a part reached by flush water immediately after flowing from the rim rear water conduit into the rim portion is made to project further toward the inside than an upper edge of the waste receiving surface, and the slit opening is formed to be narrow. Thus, while one of the flush water stream is circulated clockwise on the shelf portion, and the other flush water stream is circulated counterclockwise on the shelf portion. The flush water circulating clockwise forms a main flow. The main flow makes a U-turn at a front portion of the bowl surface and pushes waste in the direction of a discharge trap. The flush water circulating counter-clockwise on the shelf portion flows into a rear surface portion of the bowl surface in the vicinity of a portion connecting the rim rear water conduit and the rim portion.

SUMMARY OF INVENTION

Technical Problem

In the conventional flush toilet 101 of this type, however, because of the requirement in recent years for water conservation, when flush water volumes are reduced and flushing is attempted with a low flush water volume, the flush water supplied to the rim water passage 120 has a lower flow force due to that reduced flush water volume, and almost all the flush water from the slit opening 134 close to a merging part where the rim rear water conduit 110 merges with the rim water passage 120 flows down onto the waste receiving surface 116, as shown by flow f1. Another problem is that if the water flows down all at once toward the water accumulating surface with a relatively strong force, water splashing may occur.

On the other hand, a water flow f0 of flush water spouted from the slit opening 134 on the front side is relatively small in volume and has a lower force, because a relatively large volume of flush water is spouted from the slit opening 134 on the rear side.

Such spouted flush water therefore flows down unevenly over the waste receiving surface 116, and it was not possible to form a circulating flow capable of flushing while circulating relatively uniformly over the entire waste receiving surface 116. This led to the problem of poor flushing of the waste receiving surface 116.

In the conventional flush toilet such as that shown in Patent Document 1, as well, if an inside end of a shelf portion in a part where flush water merges from the rim rear water conduit with the rim portion is merely made to project to the inside more than the upper edge of the waste receiving surface, and the slit opening width is made narrow, a relatively large volume of flush water will be spouted from the rear-side slit opening, and it will still not be possible to strengthen the force of the flush water seeking to circulate in the rim passage; and therefore, flush water cannot circulate sufficiently to make a full revolution of the rim passage, a circulating flow for flushing the whole waste receiving surface while circulating relatively uniformly cannot be formed, and flushing of the waste receiving surface is poor.

Also, when the flush water volume is reduced and an attempt is made to flush with a small volume of flush water due to the requirement for water conservation, these problems become more pronounced, and the problem of poor flushing of the waste receiving surface arises.

The inventors of the present invention therefore conducted further research into a structure capable of forming a circulating flow for flushing as it circulated relatively uniformly over the entire waste receiving surface in a flush toilet with an open rim structured.

In a flush toilet comprising an open rim structure, changing the size of the slit opening portion over a relatively wide area requires changing the shape of the toilet main body itself.

When so doing, the externally viewed shape of the toilet main body has left-right asymmetrical, therefore a conceivable problem is that aesthetic appeal from a user's view point will be degraded in the toilet space, where aesthetic appeal is considered important to improving the user's perceived image.

The present invention was undertaken to resolve the above-described problems with the conventional art, and has the object of providing a flush toilet with which a circulating flow can be formed to flush over the entire waste receiving surface as it circulates relatively uniformly, able to limit localized changes in external appearance of the toilet main body to give users an impression of a left-right symmetrical external shape, and to maintain good design characteristics.

Solution to Problem

In order to accomplish the above-described object, the present invention provides a flush toilet for flushing a toilet main body with flush water, which includes: a water supply apparatus for supplying the flush water to a supply port of the toilet main body; a bowl portion having a bowl-shaped waste receiving surface and a rim portion provided on or above an upper edge portion of the bowl-shaped waste receiving surface, the rim portion forming a rim passage for guiding the flush water to an inner part, the upper edge portion of the bowl-shaped waste receiving surface being formed to be left-right asymmetrical relative to a front-to-back center cross section; a discharge path connected to a bottom portion of the bowl portion for discharging waste together with the flush water; and a rim rear water conduit extending forward from the supply port, the rim rear water conduit including a connecting water conduit connected to the rim passage, the connecting water conduit being directed to the rim passage on a first side that is one of left and right sides relative to the front-to-back center cross section of the toilet main body, wherein the rim portion includes: a rim inside wall formed to be left-right symmetrical relative to the front-to-back center cross section; and a slit opening portion formed between the upper edge portion of the bowl-shaped waste receiving surface formed to be left-right asymmetrical relative to the front-to-back center cross section and the rim inside wall formed to be left-right symmetrical relative to the front-to-back center cross section; wherein the slit opening portion is formed in such a manner that a slit gap of the slit opening portion on the first side is smaller than a slit gap of the slit opening portion on a second side being the other of the left and right sides relative to the front-to-back center cross section, thereby a circulating flow is formed on the waste receiving surface by the flush water spouted from the slit opening portion.

In the invention thus constituted, the slit opening portion is formed such that the slit gap of the slit opening portion on the first side is smaller than the slit gap of the slit opening portion on the second side being the other of the left and right sides relative to the front-to-back center cross section. Therefore a circulating flow can be formed to flush over the entire waste receiving surface while circulating relatively uniformly by adjusting the volume of the flush water spouted from the slit opening portion forming the different slit gaps, so as to reduce on the slit opening portion on the first side as well as increase on the slit opening portion on the second side, the volume of circulating flush water spouted onto the waste receiving surface from the main flow which circulates within the rim passage from the side to which the connecting water conduit of the rim rear water conduit is directed. It is also possible to constrain flush water from flowing down along the waste receiving surface, so as to essentially drop down from the upstream-side slit opening portion on the first side, and thereby to constrain splashing of flush water to outside the toilet.

Also, since parts of the waste receiving surface with low visibility to the user to see are formed with left-right symmetry, and the rim inside wall, which is easily visible to the user, is formed with left-right symmetry, localized changes in the external appearance of the toilet main body can be constrained and an impression of the external appearance with left-right symmetry can be conveyed to the user, so that in the toilet space, where aesthetic appeal is considered important to make even the smallest improvement in user-perceived image, favorable aesthetic appeal and favorable design characteristics can be preserved.

In the present invention, preferably, the slit opening portion is formed in such a manner that an expanded slit gap portion is formed in a part of a front region of the toilet main body a slit gap in the expanded slit gap portion being larger than a slit gap on an upstream side of the expanded slit gap portion as well as larger than a slit gap on a downstream side of the expanded slit gap portion.

In the invention thus constituted, the volume of flush water spouted from the slit opening portion forming different slit gaps can be adjusted so that the volume of the circulating flush water flow spouted onto the waste receiving surface from a main flow circulating inside the rim passage is increased in the expanded slit gap portion disposed on the front side of the toilet main body, and a circulating flow can be formed to flush over the entire waste receiving surface as it circulates relatively uniformly.

In the present invention, preferably, the slit opening portion is formed in such a manner that a slit gap of the slit opening portion on the first side gradually increases from a back end portion of the rim portion to a portion on the first side of the rim portion.

In the invention thus constituted, on the first side where the connecting water conduit of the rim rear water conduit is directed, the slit gap may be formed to be relatively small in the back end portion of the rim portion where the flow force is strongest and the volume of water is large, and may be formed to gradually increase from the back end portion of the rim portion to the first side portion of the rim portion as the flow force gradually weakens and the volume of water gradually decreases. Therefore by adjusting the volume of water in the circulating flush water flow spouted from a main flow circulating in the rim passage onto the waste receiving surface so that the volume of spouted flush water is gradually increased in the slit opening portion from the back end portion up to the first side portion on the first side rim portion, a circulating flow can be formed which flushes the entire waste receiving surface as it circulates relatively uniformly.

In the present invention, preferably, the slit opening portion is formed in such a manner that a slit gap of the slit opening portion on the first side is smaller than a slit gap on the slit opening portion on the second side in a left-right cross section in a middle portion of the bowl portion.

In the invention thus constituted, in the left-right center cross section in the middle portion of the bowl portion, by adjusting the flush water volume spouted from slit opening portions of differing slit gaps so that the volume of circulating flush water flow spouted onto the waste receiving surface from a main flow circulating in the rim water passage is reduced in the slit opening portion on the first side and increased in the slit opening portion on the second side, a circulating flow can be formed which flushes the entire waste receiving surface while circulating relatively uniformly.

In the present invention, preferably, the slit opening portion is formed in such a manner that a slit gap of the slit opening portion on the first side is smaller than a slit gap on the slit opening portion on the second side in a left-right cross section in a rear portion of the bowl portion.

In the invention thus constituted, in the left-right cross section in the rear portion of the bowl portion, by adjusting the flush water volume spouted from slit opening portion forming different slit gaps so that the volume of circulating flush water flow spouted onto the waste receiving surface from a main flow circulating in the rim water passage is reduced in the slit opening portion on the first side and increased in the slit opening portion on the second side, a circulating flow can be formed which flushes the entire waste receiving surface while circulating relatively uniformly.

In the present invention, preferably, the slit opening portion is formed in such a manner that a rate of change of a slit gap of the slit opening portion on the first side gradually increasing from a back end portion of the rim portion to a portion on the first side of the rim portion is smaller than a rate of change of a slit gap of the slit opening portion on the second side gradually increasing from the back end portion of the rim portion to a portion on the second side of the rim portion.

The invention thus constituted is formed so that on the first side where the flush flow force from the rim rear water conduit is relatively strong, the change percentage by which the slit gap gradually increases from the back end portion to the first side portion of the rim portion is small, and the volume of the circulating flush water flow spouted onto the waste-receiving surface from the main flow circulating in the rim water passage is constrained so that it has difficulty increasing in the slit opening portion on the first side, where flow force is relatively strong. On the other hand, on the second side where the flush water primarily circulating in the rim water passage reaches and the flow force becomes relatively weak, the change percentage is relatively large so that the slit gap gradually increases from the back end portion of the rim portion to the second side portion of the rim portion. Therefore the volume of circulating flush water flow spouted onto the waste-receiving surface from the main flow circulating in the rim water passage 20 is made difficult to reduce, even in the vicinity of the back end portion of the slit opening portion on the second side, where the flow force becomes relatively weak. The percentage change in the volume of the flush water spouted from the slit opening portion can be adjusted by making the percentage change to the size of the slit gap on the first side different from the percentage change to the size of the slit gap on the second side, and a circulating flow can be formed to flush the entire waste-receiving surface 16 while circulating relatively uniformly.

In the present invention, preferably, the slit opening portion is formed in such a manner that a slit gap of the slit opening portion on the first side gradually increases from a back end portion of the rim portion to a front end portion of the rim portion.

In the invention thus constituted, on the first side, the slit gap may be formed to be relatively small in the back end portion of the rim passage where the flow force is strongest and the volume of water is large, and may be formed to gradually increase from the back end portion of the rim portion to the front end portion of the rim portion as the flow force gradually weakens and the volume of water gradually decreases. Therefore by adjusting the volume of circulating flush water flow spouted onto the waste-receiving surface from the main flow circulating in the rim water passage to gradually increase using gradually larger slit gap, a circulating flow can be formed which flushes the entire waste receiving surface as it circulates relatively uniformly.

In the present invention, preferably, a connecting portion is provided between the upper edge portion of the waste receiving surface and the rim inside wall.

In the invention thus constituted, by using a connecting portion to connect between the upper edge portion of the waste receiving surface and the rim inside wall, the size of slits formed between the upper edge portion of the waste receiving surface and the rim inside wall can be relatively easily manufactured to specification. Therefore when forming the slit gap, increases in the cost of overseeing inspection, adjustment, and modifications, etc. of the slit gap size, and by extension the manufacturing cost, can be constrained.

In the present invention, preferably, the rim portion is formed in such a manner that a width of the rim portion on the first side is equal to a width of the rim portion on the second side.

In the invention thus constituted the rim portion is formed so that the first side rim portion width is the same as the second side rim portion width, therefore the rim portion width visible to the user is formed with left-right symmetry. Therefore localized changes in the external appearance of the toilet main body can be constrained, a left-right symmetrical external shape can be formed, and design characteristics can be favorably preserved.

Advantageous Effects of Invention

According to the flush toilet of the present invention, a circulating flow can be formed to circulate relatively uniformly over the waste receiving surface while flushing, localized changes in the external appearance of the toilet main body can be constrained, and an impression of a left-right symmetrical external shape can be conveyed to users, so that design characteristics are favorably preserved.

DESCRIPTION OF EMBODIMENTS

Hereinafter, with respect to the attached figures, we explain a flush toilet according to an embodiment of the invention.

Figure 1:
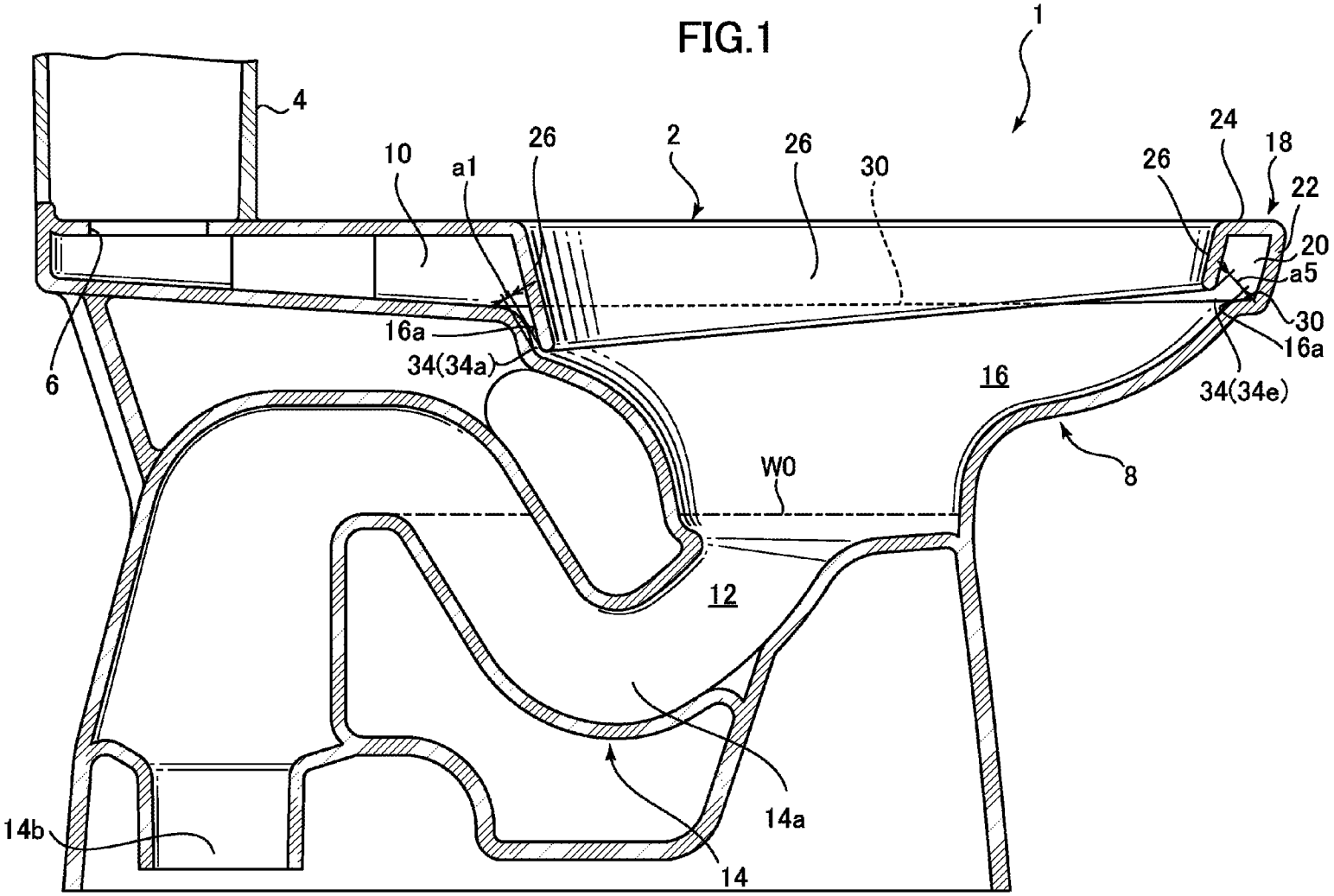
FIG. 1 is a side elevation cross section view showing a flush toilet according to an embodiment of the invention.
Figure 2:
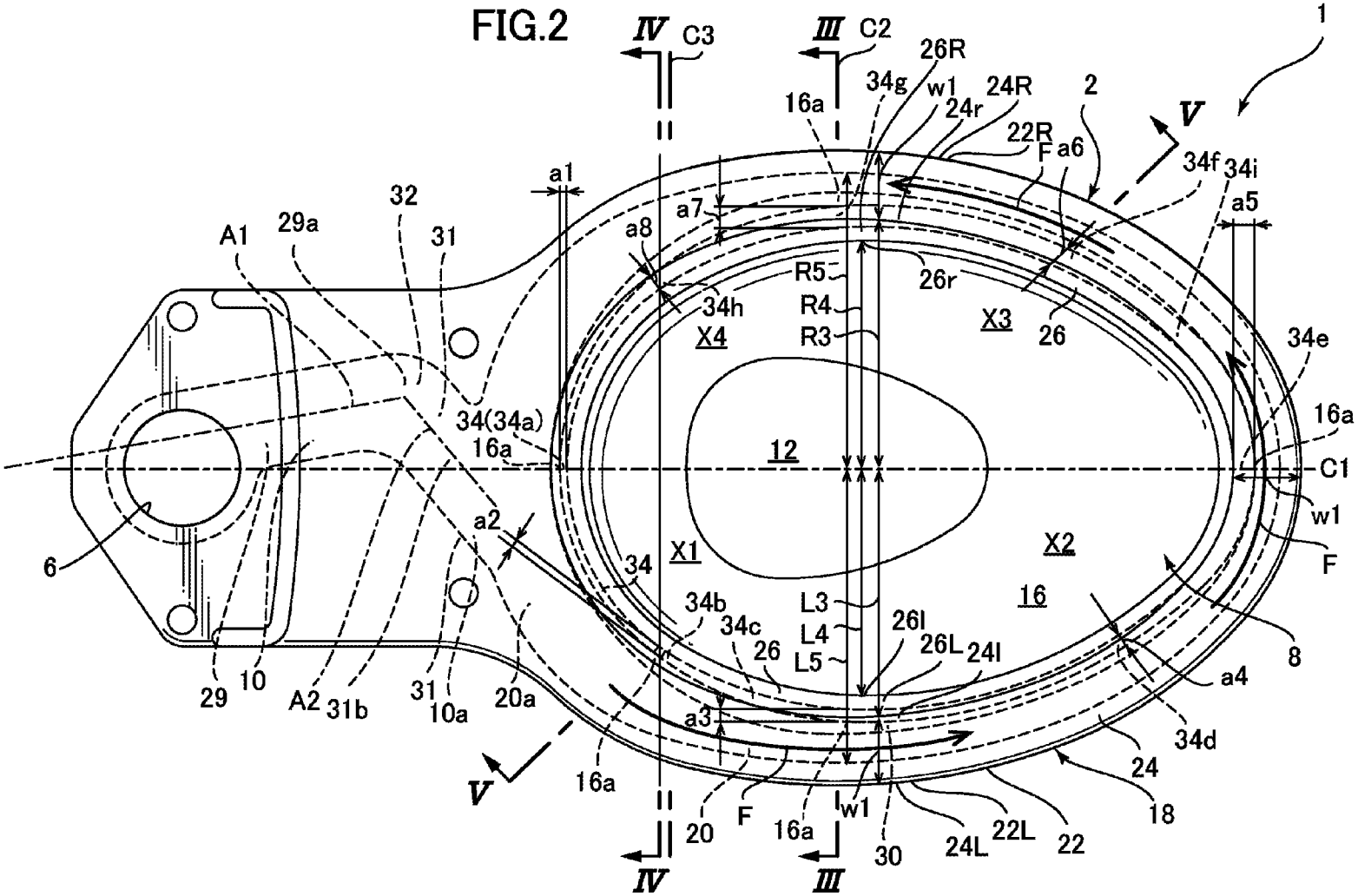
FIG. 2 is a plan view of a toilet main body of the flush toilet according to the embodiment of the invention.

FIG. 1 is a side elevation cross section showing a flush toilet according to an embodiment of the invention. FIG. 2 is a plan view of a toilet main body in the flush toilet according to the embodiment of the invention. Below, in explaining the embodiment of the invention, we assume the closest side as seen by a user using the toilet main body 2 is the front side, the side seen as the far side from the user is the rear side, the side of the toilet main body 2 seen on the right from the front is the right side, and the side thereon seen on the left is the left side.

As shown in FIGS. 1 and 2, the flush toilet 1 according to the embodiment of the invention has a toilet main body 2 made of ceramic or the like. The toilet main body 2 may also be formed of resin and porcelain, or of resin only. A water supply apparatus shown as a reservoir tank 4, being a flush water source, is installed at a top portion on the rear side of the toilet main body 2. Also, the reservoir tank 4 is connected to a water supply source such as a public water supply. When a flush operation is started by operating an operating lever (not shown) installed on the reservoir tank 4, a discharge valve (not shown) on the reservoir tank 4 is opened and a predetermined flush water volume (e.g., 6 liters) is supplied from the reservoir tank 4 to a supply port 6, which is located on a top portion on the center rear side of the toilet main body 2. The supply port 6 may not only be formed in the center, but also may be formed with an offset to the left or right side from the front-to-back center cross section C.

The flush toilet 1 of the present embodiment may be used in water-conserving toilets supplied from the reservoir tank 4 with 3 to 6 liters of flush water, and preferably in water-conserving toilets supplied from the reservoir tank 4 with 4.8 to 6 liters of flush water.

The water supply apparatus shown by the reservoir tank 4 may, in addition to being a reservoir tank, also be any other water supply apparatus such as a flush valve or the like capable of supplying a specified quantity of flush water.

A bowl portion 8 is formed at the front top portion of the toilet main body 2. At the rear upper portion of the toilet main body 2, a rim rear water conduit 10, for conducting flush water supplied from the reservoir tank 4 from the supply port 6 to the rim water passage 20, is formed between the supply port 6, to which the downstream end portion of the reservoir tank 4 is connected, and the rim water passage 20, described below. Note that in the present embodiment a partial flow path of the rim rear water conduit 10 and the rim water passage 20 may be formed using a distributor or other structure.

Additionally, a water accumulating portion 12 is formed at the bottom of the bowl portion 8. A predetermined quantity of accumulated water is stored therein, having an accumulated water surface at the initial water level as shown by W0. An inlet 14*a* of a discharge trap pipe 14 (discharge path) is connected to the bottom end of the water accumulating portion 12. The discharge trap pipe 14 extends rearward from the inlet 14*a*, and a back end 14*b* thereof is connected to a discharge pipe (not shown) which is installed on the floor.

Additionally, the bowl portion 8 includes a waste-receiving surface 16 formed in a bowl shape, and a rim portion 18 forming a rim water passage 20 for guiding flush water to inner part of the rim portion 18 over the upper edge portion of the waste-receiving surface 16.

The rim rear water conduit 10 is formed to extend forward from the supply port 6, and so that the connecting water conduit 10*a* connecting to the rim water passage 20 is directed to face the rim water passage 20 on a first side, being either the left or right side relative to the front-to-back direction center cross section C1 (left side in the embodiment). Here the front-to-back center cross section C1 is a cross section cut front-to-back through the toilet main body 2 so as divide the bowl portion 8 in two in the left-right direction.

The rim rear water conduit 10 includes an upstream rim rear water conduit 29, extending from the vicinity of the supply port 6 disposed at the center as seen from in front of the toilet main body 2 to either the left or right side of the toilet main body 2 (right side in the embodiment), and a downstream rim rear water conduit 31, extending from this upstream rim rear water conduit 29 to either the left or right side (left side in the embodiment). The rim rear water conduit 10 forms a left-right asymmetrical flow path with respect to the front-to-back center cross section C1. The rim rear water conduit 10 is formed into a sideways "V" shape by the upstream rim rear water conduit 29 and the downstream rim rear water conduit 31. A bent portion 32 connecting the upstream rim rear water conduit 29 and the downstream rim rear water conduit 31, which respectively extend in different directions, is positioned off-center in right side area of the front-to-back center cross section C1 of the toilet main body 2. The downstream rim rear water conduit 31 is formed so that after first returning downstream to the center cross section C1 from upstream, it is then gradually offset toward the left region. Therefore the rim rear water conduit 10 is formed so that the length of the overall water conduit is longer than in the past.

The upstream rim rear water conduit 29 extends from the supply port 6 on the toilet main body 2 center cross section C1 in a diagonal straight line toward the right side, and is disposed in an asymmetric position relative to the center cross section C1, extending up to the upstream rim water conduit outlet portion 29*a* disposed in the right side region relative to the center cross section C1. The upstream rim rear water conduit 29 is formed to gradually skew toward the right region relative to center cross section C1 from upstream toward downstream. The center axial line A1 of the upstream rim rear water conduit 29 is disposed to slope outwardly to the right at the front, relative to the center cross section C1.

The downstream rim rear water conduit 31 extends leftward from the downstream rim water conduit inlet portion 31*a* connected to the bent portion 32, forming a flow path reaching the downstream rim water conduit outlet portion 31*b* (connecting water conduit 10*a*) connected to the left side rear portion area 20*a* of the rim water passage 20. The downstream rim rear water conduit 31 forms a straight line flow path from the downstream rim water conduit inlet portion 31*a* to the downstream rim water conduit outlet portion 31*b* so as to traverse the toilet main body 2 center cross section C1 diagonally.

The center axial line A2 of the downstream rim rear water conduit 31 is disposed to slope outwardly to the left at the front, relative to the center cross section C1. The intersection of the upstream rim rear water conduit 29 center axial line A1 and the downstream rim rear water conduit 31 center axial line A2 is positioned to the right side of the center cross section C1, whereas the downstream rim water conduit outlet portion 31*b* is positioned on the opposite, left side of the center cross section C1.

The downstream rim rear water conduit 31 has a relatively long flow path, therefore in the center of the downstream rim rear water conduit 31, the flush water flow can be well aligned in the direction of the downstream rim rear water conduit 31, and flush water directionality can be increased so that it is spouted in an aligned flow, circulating from the downstream rim water conduit outlet portion 31*b* (connecting water conduit 10*a*) over the rim water passage 20, and flowing in with a relatively strong flow force.

The downstream rim rear water conduit 31 is formed so that a part thereof is parallel to a portion of the merging part of the rim water passage 20. In the vicinity of the downstream rim water conduit outlet portion 31*b*, the direction of the downstream rim rear water conduit 31 center axial line A2 and the direction of the flush water flow line seeking to circulate in the rim water passage 20 in the left rear area of the bowl portion 8 are essentially matched, so that the flush water flowing out from the downstream rim water conduit outlet portion 31*b* can flow in the same rotating direction (circulating direction) on the rim water passage 20 and form a flow which seeks to circulate on the rim water passage 20 with the flow force maintained (with the flow volume and flow velocity essentially maintained). Hence the flush water merging from the downstream rim rear water conduit 31 into the rim water passage 20 can be prevented from flowing over the rim water passage 20 in a circulating direction opposing the main flow F over the rim passage, and from flowing down onto the waste-receiving surface 16 from the rear portion slit opening portion 34, as described below.

Next we explain the rim portion 18 in detail.

As shown in FIGS. 1 through 5, the rim portion 18 is formed as the upper edge portion of the bowl portion 8 in an annular shape over the entire circumference thereof.

Figure 3:
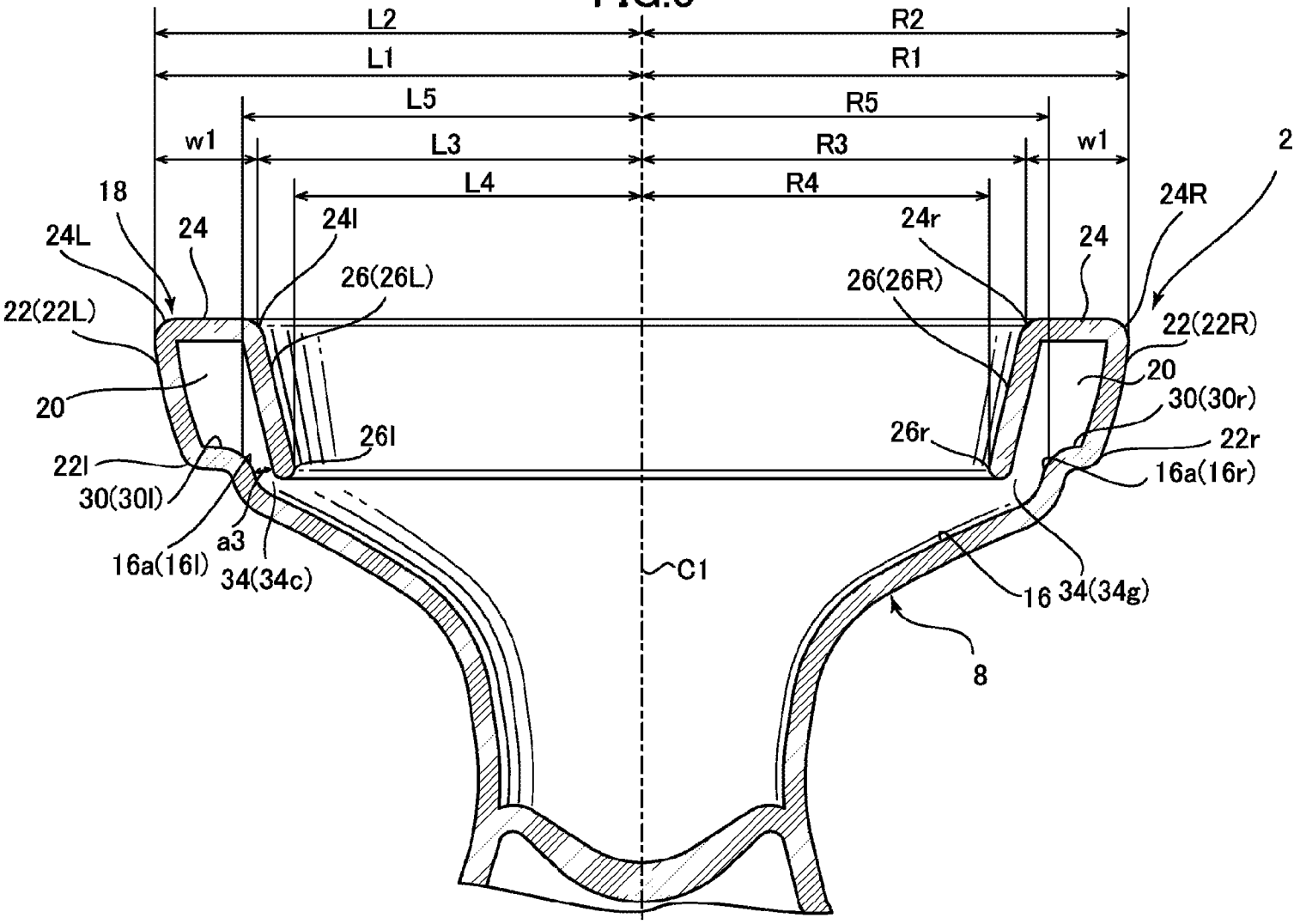
FIG. 3 is a cross section view taken along the line of III-III in FIG. 2.
Figure 4:
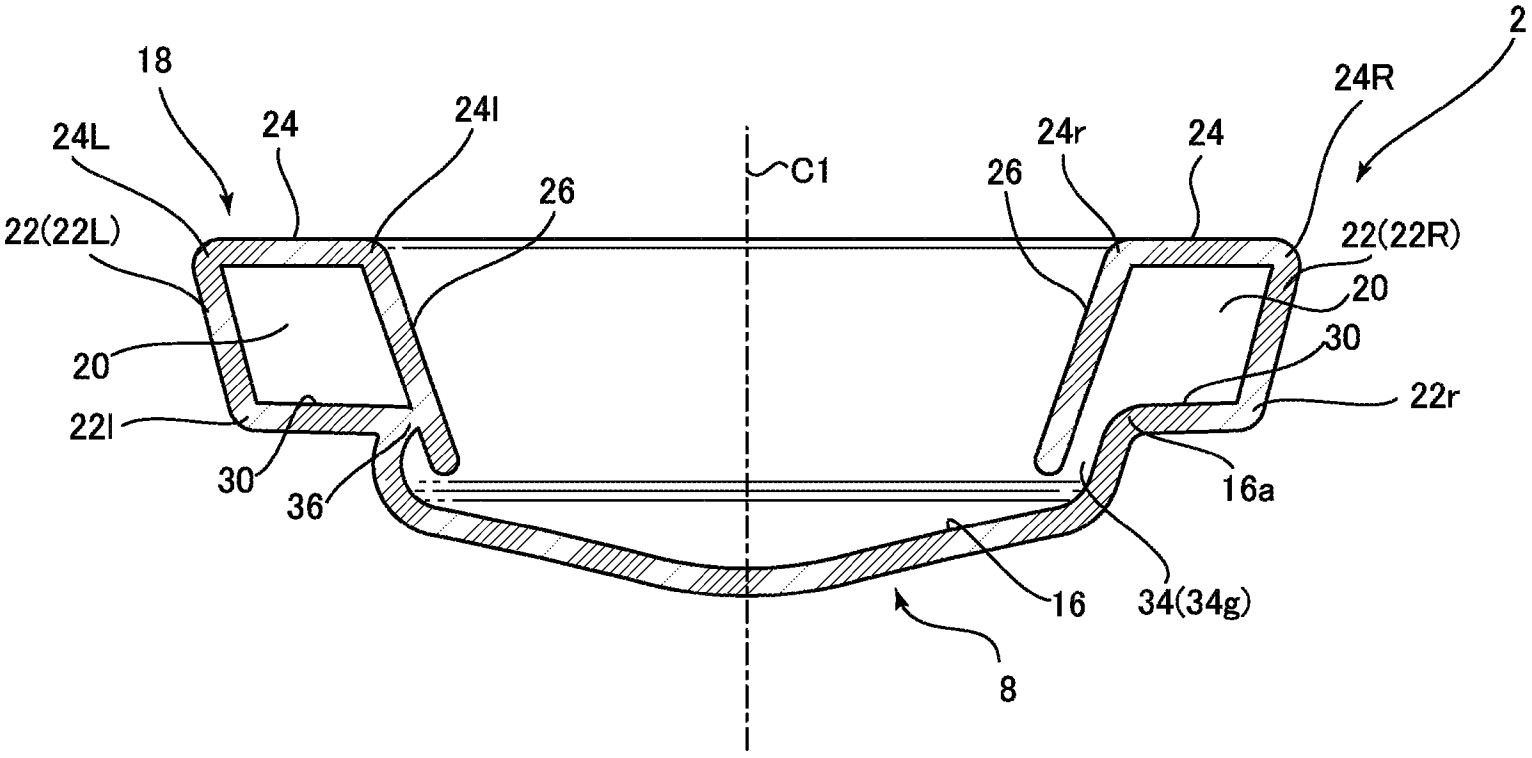
FIG. 4 is a cross section view taken along the line of IV-IV in FIG. 2.
Figure 5:
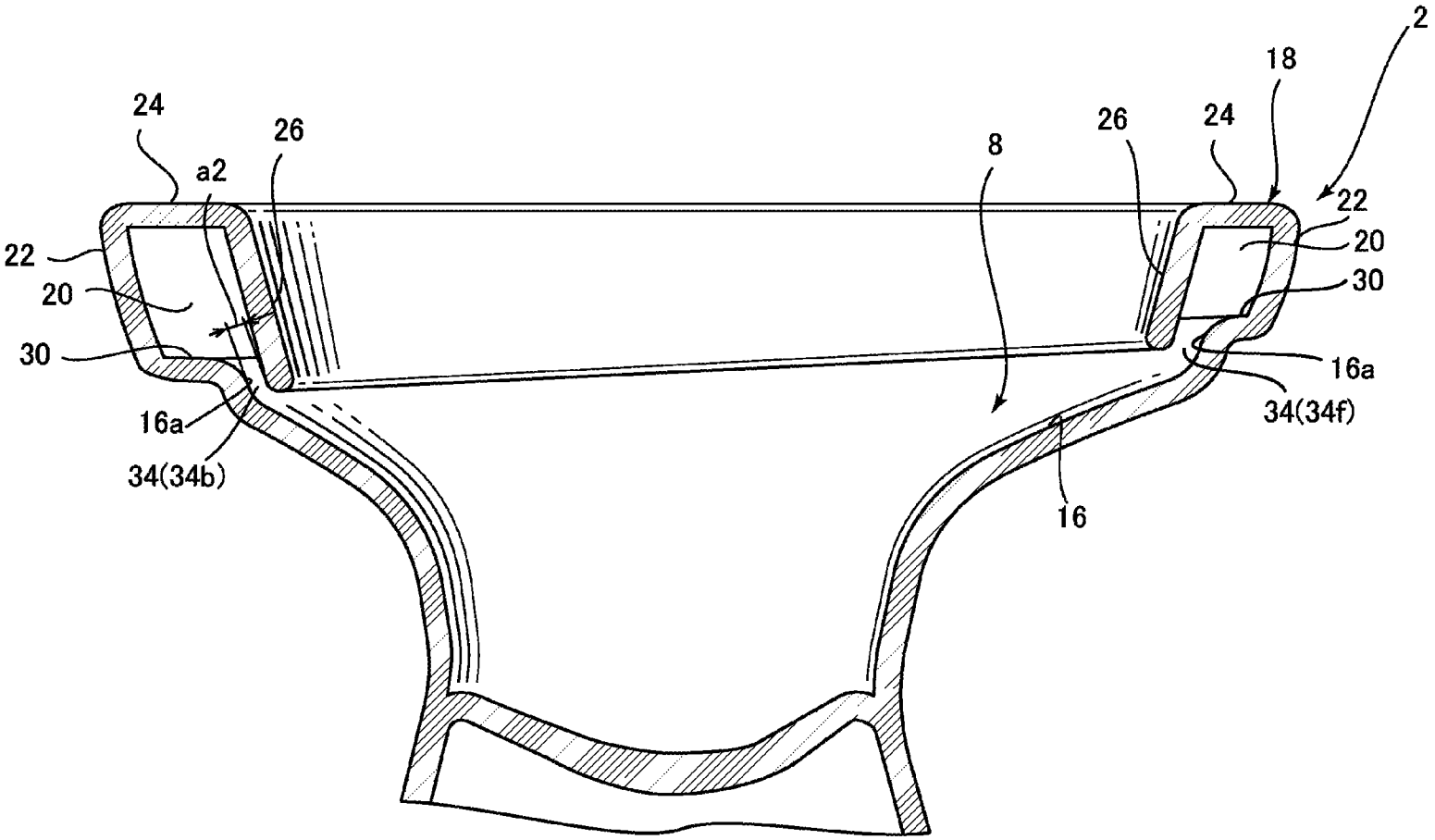
FIG. 5 is a cross section view taken along the line of V-V in FIG. 2.

FIG. 3 is a cross section view taken along the line of III-III in FIG. 2. FIG. 4 is a cross section view taken along the line of IV-IV in FIG. 2. FIG. 5 is a cross section view taken along the line of V-V in FIG. 2.

The rim portion 18 includes: a rim outside wall 22 forming the outer circumferential surface of the rim portion 18 and formed in a standing wall shape rising up the outside surface of the toilet main body 2 to the peak thereof, a rim peak surface portion 24 forming a flat surface at the peak of the rim portion 18; a rim inside wall 26 forming the inner circumferential surface of the rim portion 18 and extending so as to hang down slightly inward from the rim peak surface portion 24, and formed to be left-right symmetrical relative to the front-to-back center cross section C1 extending in the front-to-back direction; a slit opening portion 34 opening downward, for forming a spouting portion on the rim portion 18 below the rim water passage 20; and a rim passage bottom surface 30, in which a flat surface extending outward from the upper edge portion 16*a* of the waste-receiving surface 16 is formed, and an annular, essentially flat surface is formed over essentially the entire perimeter of the bowl portion 8.

The rim outside wall 22 is formed to extend downward from the outside end portion of the rim peak surface portion 24. The rim outside wall 22 is formed in an ellipse as seen from above, and a vertical wall of a predetermined height is formed on the circumference thereof. As shown in FIGS. 2 and 3, the rim outside wall 22 is formed to be symmetrical relative to a front-to-back center cross section C1 extending in the front-back direction as seen from above, and the distance R1 from the front-to-back center cross section C1 to the rim outside right wall 22R is formed to be the same as the distance L1 from the front-to-back center cross section C1 to the rim outside left wall 22L. For example, in a left-right center cross section C2 dividing the toilet main body 2 bowl portion 8 in two parts in approximately the front-back direction, the distance R1 from the front-to-back center cross section C1 to the rim outside right wall 22R is formed to be the same as the distance L1 from the front-to-back center cross section C1 to the rim outside left wall 22L. Note that in the elliptically shaped bowl portion 8, the left-right center cross section C2 cuts through the center cross section of the part where the bowl portion 8 has a maximum width in the left-right direction, which is to say the part where the rim outside wall 22 is at maximum distance from the front-to-back center cross section C1 in the left-right direction, as the center of the bowl portion 8.

The rim outside wall 22 is formed so that the distance from the front-to-back center cross section C1 to the rim outside right wall bottom end 22*r* of the rim outside right wall 22R is also the same as the distance from the front-to-back center cross section C1 to the rim outside left wall bottom end 22*l* of the rim outside left wall 22L. The rim outside wall 22 is also formed so that the distance from the front-to-back center cross section C1 to the top end of the rim outside right wall 22R is the same as the distance from the front-to-back center cross section C1 to the top end of the rim outside left wall 22L.

Therefore, as seen from above, the rim outside wall 22 has the appearance of left-right symmetry relative to the front-to-back center cross section C1, and offers design characteristics enabling the aesthetic appeal of left-right symmetry to be perceived.

The rim peak surface portion 24 forms the peak surface of the toilet main body 2, and forms an annular plane. The rim peak surface portion 24 forms a flat surface extending essentially horizontally from the top end of the rim outside wall 22 to the top end of the rim inside wall 26. As seen in top plan view, the rim peak surface portion 24 is formed with left-right symmetry relative to the front-to-back center cross section C1. I.e., the rim peak surface portion 24 is formed so that in the left-right direction of any of the areas from the rear portion to the front portion of the bowl portion 8, the distance R2 from the front-to-back center cross section C1 to the rim peak surface outside right end 24R is formed to be the same as the distance L2 from the front-to-back center cross section C1 to the rim peak surface outside left end 24L. Also, the rim peak surface portion 24 is formed so that in the left-right direction of any of the areas from the rear portion to the front portion of the bowl portion 8, the distance R3 from the front-to-back center cross section C1 to the rim peak surface inside right end 24*r* is formed to be the same as the distance L3 from the front-to-back center cross section C1 to the rim peak surface inside left end 241. Therefore, as seen in top plan view, in the left-right direction in any region from the rear portion to the front portion of the bowl portion 8, the outside shape of the rim peak surface portion 24, i.e., the outside shape of the toilet main body 2, is formed to be left-right symmetrical relative to the front-to-back center cross section C1. Therefore, in the left-right cross section of any of the areas from the rear portion to the front portion of the bowl portion 8, in the rim peak surface portion 24, the width W1 of the rim peak surface portion 24 is formed so that the width of the rim peak surface right side part is the same size as the width of the rim peak surface left side part.

The rim inside wall 26 is formed to extend downward from the inside end portion of the rim peak surface portion 24. As seen from above, the rim inside wall 26 is formed in an elliptical shape, and is formed around as a vertical wall of a predetermined height. The rim inside wall 26 extends so as to hang from its top end down to the vicinity of the waste-receiving surface 16, forming a hanging wall portion, which forms the rim water passage 20 in the interior of the rim portion 18 (its own exterior as seen from the center of the toilet main body 2). As seen from above, the rim inside wall 26 is formed to be left-right symmetrical relative to the front-to-back center cross section C1, and so that the distance from the front-to-back center cross section C1 to the rim inside right wall 26R is the same as the distance from the front-to-back center cross section C1 to the rim inside left wall 26L. For example, the rim inside wall 26 is formed so that the distance R4 from the front-to-back center cross section C1 to the rim inside right wall bottom end 26*r* is the same as the distance L4 from the front-to-back center cross section C1 to the rim inside left wall bottom end 26*l*. Therefore, as seen from above, the rim inside wall 26 has the appearance of left-right symmetry relative to the front-to-back center cross section C1, and offers design characteristics such that the aesthetic beauty of left-right symmetry can be perceived. Also, for purposes of explanation, we refer to the lower end of the rim inside wall 26 (including the rim inside right wall bottom end 26*r* and the rim inside left wall bottom end 26*l*) collectively as the rim inside wall bottom end portion 26*a*.

The rim passage bottom surface 30 forms an essentially flat surface, which forms an annular bottom surface of the annular rim water passage 20 inside the rim portion 18, forming a relatively flat flow path through which the flush water can circulate through the rim portion 18. From the outward direction toward the inward direction with respect to the bowl portion 8, the rim passage bottom surface 30 extends essentially horizontally. For example, it forms an essentially flat surface extending essentially horizontally in an inward direction from the inside of the rim outside right wall bottom end 22*r* and the rim outside left wall bottom end 22*l*.

This configuration enables the formation of a flow in which the flush water supplied from the rim rear water conduit 10 makes a revolution around an upper portion of the bowl portion 8 as it flows on the rim passage bottom surface 30 in the rim water passage 20. I.e., the flush toilet 1 of the present embodiment is a flush toilet of the type in which the flush water in a rim water passage 20 of an open-rim type structure forms a flow in a single direction, circulating in either the clockwise or counter-clockwise direction from either the left or right.

Next we explain in more detail the slit opening portion 34 formed beneath an open rim-type rim portion 18.

As shown in FIGS. 1 through 4, the slit opening portion 34 is an opening portion formed between the upper edge portion 16*a* of a waste-receiving surface 16 formed to be left-right asymmetrical relative to the front-to-back center cross section C1, and the rim inside wall 26 formed to be left-right symmetrical relative to the front-to-back center cross section C1. Even in the front end region and back end region on the front-to-back center cross section C1 of the bowl portion 8, a slit opening portion 34 is formed between the waste-receiving surface 16 upper edge portion 16*a* and the rim inside wall 26. This is an open rim portion of what is known as the open type, open over the entire circumference beneath the rim water passage formed along the circumference of the rim portion 18. The slit opening portion 34 is formed into a downward-opening slit shape. The size of the slit opening portion 34 is determined by the width of the flow path between the upper edge portion 16*a* and the rim inside wall 26. For example, the size of the slit opening portion 34 may be determined by the length of a perpendicular line dropped from the rim inside wall 26 to the upper edge portion 16*a*. The slit opening portion 34 is disposed so that between the rim inside wall 26 and the upper edge portion 16*a* it is covered above by the rim portion 18, thereby reducing its exposure as an external appearance perceived by users.

First we explain the waste-receiving surface 16, which is formed to be left-right asymmetrical relative to the front-to-back center cross section C1.

The waste-receiving surface 16 is formed so that in the left-right cross section thereof, regardless of which area is selected from the rear portion to the front portion of the waste-receiving surface 16, the size of the waste-receiving surface 16 on one side (the left side in the present embodiment), to which the connecting water conduit 10*a* of the rim rear water conduit 10 on the waste-receiving surface 16 is directed, is smaller than the size of the waste-receiving surface 16 on the other side (the right side in the present embodiment) relative to the front-to-back center cross section C1.

The waste-receiving surface 16 is formed so that in the left-right cross section thereof, regardless of which area is selected from the rear portion to the front portion of the waste-receiving surface 16, the length L5 from the front-to-back center cross section C1 to the waste-receiving surface left side top edge portion 16*l* on one side (the left side in the present embodiment), to which the connecting water conduit 10*a* of the rim rear water conduit 10 is directed, is shorter than the length R5 from the front-to-back center cross section C1 to the waste-receiving surface right side top edge portion 16*r* on the other side (the right side in the present embodiment) relative to the front-to-back center cross section C1.

The waste-receiving surface 16 is formed so that in the left-right cross section thereof, regardless of which area is selected from the rear portion to the front portion of the waste-receiving surface 16, the length between the aforementioned rim inside left wall bottom end 26*l* and the waste-receiving surface left side top edge portion 16*l* on one side is shorter than the distance between the rim inside right wall bottom end 26*r* and the waste-receiving surface right side top edge portion 16*r* on the opposing other side.

As shown in FIG. 2, the waste-receiving surface 16 is formed to be front-back asymmetrical relative to the left-right center cross section C2.

As shown in FIG. 5, the waste-receiving surface 16 is formed to be asymmetrical relative to the intersection between the front-to-back center cross section C1 and the left-right center cross section C2, even in a section cut diagonally through the right side front portion and the left side rear portion of the bowl portion 8.

The slit opening portion 34 forms a gap of a predetermined slit gap width, formed between the upper edge portion 16*a* of the waste-receiving surface 16 formed asymmetrically relative to the above-described front-to-back center cross section C1, and the left-right symmetrical rim inside wall 26. A predetermined slit gap in the slit opening portion 34 is formed to vary in predetermined areas.

For purposes of explanation, four divided areas, divided into four by the front-to-back center cross section C1 and the left-right center cross section C2, are defined as first area X1, second area X2, third area X3, and fourth area X4.

The part from the back end portion 34*a* to the left side portion 34*c* of the slit opening portion 34 is disposed in the first area X1. In the first area X1, the slit gap of the slit opening portion 34 at the back end portion 34*a* on the back end of the bowl portion 8 is formed to be a1 millimeters (mm). The slit gap a1 in the back end portion 34*a* at the back end of the bowl portion 8 is formed in a size range of 2 to 6 millimeters. In the left rear portion 34*b* at the left rear area of the bowl portion 8, the slit gap of the slit opening portion 34 is formed to be a2 millimeters (mm). In the left side portion 34*c* at the left rear area of the bowl portion 8, the slit gap of the slit opening portion 34 is formed to be a3 millimeters (mm). The sizes of the respective slit gaps have the relationship: a1<a2<a3. In the first area X1, the slit gap of the slit opening portion 34 is formed to gradually increase in size from the a1 size to the a3 size going from the back end portion 34*a* to the left side portion 34*c*.

The part from the left side portion 34*c* to the front end portion 34*e* of the slit opening portion 34 is disposed in the second area X2. In the second area X2, in the left side portion 34*c* at the left side area of the bowl portion 8, the slit gap of the slit opening portion 34 is formed to be a3 millimeters (mm). In the left side front portion 34*d* at the left front area of the bowl portion 8, the slit gap of the slit opening portion 34 is formed to be a4 millimeters (mm). In the front end portion 34*e* at the front end area of the bowl portion 8, the slit gap of the slit opening portion 34 is formed to be a5 millimeters (mm). The sizes of each slit gap have the relationship: a3<a4<a5. In the second area X2, the slit gap of the slit opening portion 34 is formed to gradually increase in size from the a3 size to the a5 size going from the left side portion 34*c* to the front end portion 34*e* of the bowl portion 8.

The third area X3 describes the area from the front end portion 34*e* to the right side portion 34*g* of the slit opening portion 34. In the third area X3, in the front end portion 34*e* at the front end area of the bowl portion 8, the slit gap of the slit opening portion 34 is formed to be a5 millimeters (mm). For example, the slit gap a5 in the front end portion 34*e* of the bowl portion 8 is formed in a size range from 8 to 14 millimeters. In the right side front portion 34*f* of the bowl portion 8, the slit gap of the slit opening portion 34 is formed to be a6 millimeters (mm). In the right side portion 34*g* at the right side area of the bowl portion 8, the slit gap of the slit opening portion 34 is formed to be a7 millimeters (mm). The sizes of the respective slit gaps have the relationship: a5=a6=a7. In the third area X3, the slit opening portion 34 is formed to have a constant size from the front end portion 34*e* to the right side portion 34*g* of the bowl portion 8.

The fourth area X4 describes the area from the right side portion 34*g* to the back end portion 34*a* of the slit opening portion 34. In the fourth area X4, in the right side portion 34*g* at the right side area of the bowl portion 8, the slit gap of the slit opening portion 34 is formed to be a7 millimeters (mm). In the right side rear portion 34*h* at the right rear area of the bowl portion 8, the slit gap of the slit opening portion 34 is formed to be a8 millimeters (mm). In the back end portion 34*a* at the back end area of the bowl portion 8, the slit gap of the slit opening portion 34 is formed to be a1 millimeters (mm). The sizes of the respective slit gaps have the relationship: a7>a8>a1. In the fourth area X4, the slit gap of the slit opening portion 34 is formed to gradually decrease from size a7 to size a1 going from the right side portion 34*g* in the right side area of the bowl portion 8 to the back end portion 34*a* at the back end area thereof. Here, in the fourth area X4, the slit gap of the slit opening portion 34 is formed to decrease at a relatively sudden rate from the a7 size to the a1 size.

We further explain below the relationship of the slit gaps of the slit opening portion 34, etc. as a function of area or position.

In the slit opening portion 34, as seen from the left-right direction, the slit gap of the slit opening portion 34 in the first area X1 on the first side, to which the connecting water conduit 10*a* of the rim rear water conduit 10 is directed, is formed to be smaller than the slit gap of the slit opening portion 34 in the fourth area X4 on the second side, which is on the other side relative to the front-to-back center cross section C1.

As seen in the left-right direction, the slit opening portion 34 is formed so that the slit gap of the slit opening portion 34 in the second area X2 on the first side, to which the connecting water conduit 10*a* of the rim rear water conduit 10 is directed, is smaller than the slit gap of the slit opening portion 34 in the third area X3 on the second side opposite the front-to-back center cross section C1.

The slit opening portion 34 is formed so that the slit gaps a1 and a2 of the slit opening portion 34 in the first area X1 on the first side are smaller than the slit gaps of the slit opening portion 34 in other parts, and are relatively small in size. Therefore, in the slit opening portion 34 near the outlet of the connecting water conduit 10*a* of the rim rear water conduit 10, the volume of flush water spouted to the waste-receiving surface 16 can be reduced, and a main flow F can be formed which seeks to circulate in the rim water passage 20.

The slit opening portion 34 is formed so that the slit gaps a8 and a1 of the slit opening portion 34 in the fourth area X4 on the second side are smaller than the slit gaps of the slit opening portion 34 in other parts (e.g., the third area), and are relatively large in size. Therefore, in the slit opening portion 34 close to the outlet of the connecting water conduit 10*a* of the rim rear water conduit 10 within the fourth area X4, the flush water flowing in from the connecting water conduit 10*a* can be prevented from spouting onto the waste-receiving surface 16, and a main flow F seeking to circulate through the rim water passage 20 can be formed.

The slit opening portion 34 has a slit gap expanded portion 34*i* of the sizes of the slit gaps a5 through a7, formed to be larger than the sizes of the slit gaps a1 through a4 in the first area X1 and the second area X2 on the upstream side and larger than the sizes of the slit gaps a8 through a1 in the fourth area X4 on the downstream side, at a portion of the third area X3 at the front area of the toilet main body 2. The slit gap expanded portion 34*i* forms an opening portion having maximum widths a5 through a7 of the slit opening portion 34 formed over the entire circumference. In the third area X3, the slit gap expanded portion 34*i* has a constant a5 millimeter slit gap. The slit gap expanded portion 34*i* may also be formed in a partial area of the third area X3 (a partial area on the front right side of the toilet main body 2). Thus, in the slit opening portion 34, at least a portion of the total circumference on the front area of the toilet main body 2 has a slit gap expanded portion 34*i* in which the slit gap size is expanded.

In the slit opening portion 34, the slit gaps a1 through a3 in the first area X1 on the first side, to which the connecting water conduit 10*a*, being the rim rear water conduit 10 connecting portion, is directed, are formed to gradually increase in size from the back end portion 34*a* at the back end area of the rim portion 18 to the left side portion 34*c* on the first side left area thereof (the first side portion).

The slit opening portion 34, in the left-right center cross section cut left-to-right so as to divide the bowl portion 8 in the front-to-back direction, is formed so that the slit gap a3 of the slit opening portion 34 on the first side is smaller than the slit gap a7 of the slit opening portion 34 on the second side, which is the opposite side relative to the front-to-back center cross section C1.

The slit opening portion 34 is formed so that in the left-right rear portion cross section C3 cut through the rear portion of the bowl portion 8, the slit gap a2 of the slit opening portion 34 in the first area X1 on the first side is smaller than the slit gap a8 of the slit opening portion 34 in the fourth area X4 on the second side, which is the opposite side relative to the front-to-back center cross section C1.

The slit opening portion 34 is formed so that the percentage change by which the slit gaps a1 through a3 gradually expand from the back end portion 34*a* to the left side portion 34*c* in the first area X1 is smaller than the percentage change by which the slit gaps a1 through a7 gradually expand from the back end portion 34*a* to the right side portion 34*g* in the fourth area X4.

The slit opening portion 34 is formed so that the slit gaps a1 through a5 gradually increase from the back end portion 34*a* to the front end portion 34*e* in the first area X1 and the second area X2 on the first side.

As shown in FIGS. 1 and 2, the slit opening portion 34 is formed so that in the front-to-back center cross section C1 of the bowl portion 8 the slit gap a1 of the slit opening portion 34 in the first area X1 is smaller than the slit gap a5 of the slit opening portion 34*e* in the third area X3 on the opposite side relative to the center.

As shown in FIG. 5, the slit opening portion 34 is formed so that in the diagonal center cross section, cut so as to divide the bowl portion 8 in two in the diagonal direction as seen from above, the slit gap a2 of the slit opening portion 34*b* in the first area X1 is smaller than the slit gap a6 in the slit opening portion 34*f* in the third area X3 on the opposite side relative to the center.

The slit opening portion 34 comprises, in a portion within the total circumference, a connecting portion 36 connecting the waste-receiving surface 16 upper edge portion 16*a* and the rim inside wall 26 so as to define the gap between them.

The connecting portion 36 is connected so that the waste-receiving surface 16 upper edge portion 16*a* is made to project toward the inside of the rim inside wall 26. The connecting portion 36 may also be a connecting portion for connecting the upper edge portion 16*a* and the rim inside wall 26 by a columnar connecting portion or other structure. By disposing a connecting portion 36 between the waste-receiving surface 16 upper edge portion 16*a* and the rim inside wall 26, the size of the gap between the waste-receiving surface 16 upper edge portion 16*a* and the rim inside wall 26 over a relatively wide area of the perimeter of the connecting portion 36, which is to say the size of the slit gap, can be easily formed and specified. Therefore when forming slit gaps of a relatively small size on the order of a few millimeters, the costs for adjustment, inspection, modification, and the like of the slit gap size specification during manufacturing, and therefore cost increases for manufacturing, can be constrained. Hence the percentage of the flush water spouted from a specified slit gap can be adjusted as the slit gap of the slit opening portion 34 is formed as described above, and a specified slit opening portion 34 capable of maintaining circulating flush water performance on the waste-receiving surface 16 can be manufactured at a relatively low cost. Note that the connecting portion 36 has a relatively short width (front-back direction width) of a level not affecting spouting from the slit opening portion 34.

As described above, the rim portion 18 is formed to be left-right symmetrical relative to the front-to-back center cross section C1. The rim portion 18 is formed so that in the first area X1, second area X2, third area X3, and fourth area X4 the rim portion 18 width W1 is essentially the same in any area from the toilet main body 2 center portion vicinity forward. The rim portion 18 is formed so that the rim portion width in the first area X1 and the second area X2 on the first side and is the same as the rim portion width in the fourth area X4 and third area X3 on the second side.

The rim outside right wall 22R and the rim outside left wall 22L are formed to be left-right symmetrical relative to the front-to-back center cross section C1, and the rim inside right wall 26R and rim inside left wall 26L are formed to be left-right symmetrical relative to the front-to-back center cross section C1. On the other hand the waste-receiving surface left side top edge portion 16*l* and the waste-receiving surface right side top edge portion 16*r* are formed to be left-right asymmetrical relative to the front-to-back center cross section C1.

Hence the flat rim passage bottom surface 30 of the rim water passage 20 is formed between the rim outside wall 22 and the waste-receiving surface 16 upper edge portion 16*a*, and is formed to be left-right asymmetrical relative to the front-to-back center cross section C1. More concretely, the width of the rim passage left side bottom surface 301 is formed to be larger than the width of the rim passage right side bottom surface 30*r*.

In a region where a certain width W1 of the rim portion 18 is maintained, the size of the width of the rim passage left side bottom surface 301 is inversely proportional to the size of the slit gap of the slit opening portion 34.

The width of the rim passage left side bottom surface 301 in the first area X1 on the first side is formed to become gradually smaller from a position close to the back end portion 34*a* to a position close to the left side portion 34*c* on the first side. The rim passage bottom surface 30 is formed so that in the bowl portion 8 front-to-back center cross section C1, the width of the rim passage left side bottom surface 301 on the first side becomes larger than the second side rim passage right side bottom surface 30*r* on the opposite second side relative to the front-to-back center cross section C1. As shown in FIG. 2, the rim passage bottom surface 30 is formed so that in the left-right rear portion cross section C3 cut left-to-right through the rear portion of the bowl portion 8, the width of the rim passage left side bottom surface 301 in the first area X1 on the first side becomes larger than the width of the rim passage right side bottom surface 30*r* in the fourth area X4 on the opposite second side relative to the front-to-back center cross section C1. The left-right rear portion cross section C3 indicates a cross section at a position slightly forward of the cross section taken along the FIG. 2 line IV-IV in FIG. 4. The rim passage bottom surface 30 is formed so that the change percentage by which the width of the rim passage bottom surface 30 becomes gradually smaller from the back end portion of the rim portion 18 to the left side portion thereof in the first area X1 on the first side is less than the change percentage by which the width of the rim passage bottom surface 30 becomes gradually smaller from the back end portion of the rim portion 18 to the right side portion thereof in the fourth area X4. In addition, the rim passage bottom surface 30 is formed so that the width of the rim passage bottom surface 30 becomes gradually smaller going toward the front side from the back end portion to the front end portion of the rim portion 18 in the first area X1 and second area X2 on the first side.

As described above, the vicinity of the waste-receiving surface 16 upper edge portion 16*a*, which is difficult for a user to see, is formed to be left-right asymmetrical, and the rim inside wall 26, which is easily seen by a user, is formed to be left-right symmetrical. Therefore, as seen in top plan view, localized changes in the external appearance of the toilet main body 2 can be constrained, and users can be given an impression of a left-right symmetrical external appearance, so that in the toilet space, where it is considered important to do anything possible to improve the user's aesthetic impression, design characteristics are favorably preserved.

Also, from an external appearance standpoint, the shape of the outer surface close to the left-right asymmetrically formed waste-receiving surface 16 upper edge portion 16*a* cannot be perceived unless peered at from the underside of the rim portion, i.e., is formed in a part which is extremely difficult for users to see. Therefore, an impression of a left-right symmetrical external appearance can be conveyed to the user, and design characteristics can be favorably preserved.

Note that in the flush toilet 1 according to the present embodiment, the rim rear water conduit 10 extends from the supply port 6 to the right relative to the front-to-back center cross section C1; the connecting water conduit 10*a* is directed to the left relative to the front-to-back center cross section C1, so that the flush water main flow F flowing out from the connecting water conduit 10*a* can flow in the rim water passage 20 from the left side (first side) in a direction circulating counter-clockwise toward the right side (second side). By contrast, in a flush toilet according to another embodiment, the rim rear water conduit 10 extends from the supply port 6 to the left side relative to the front-to-back center cross section C1; the connecting water conduit 10*a* is directed to the right side relative to the front-to-back center cross section, and the flush water flowing out from the connecting water conduit 10*a* can flow in the rim water passage 20 from the right side (second side) in a direction circulating clockwise toward the left side (first side). In flush toilets according to such other embodiments, as well, by forming a flow path shaped so that the present embodiment toilet main body 2 flow path shape is left-right reversed, a left-right asymmetrical waste-receiving surface 16 can be constituted relative to the left-right symmetrical rim inside wall 26, etc., as in the toilet main body 2 of the present embodiment; the slit opening portion can be formed to a predetermined size, and a circulating flow can be formed which flushes the entire waste receiving surface while circulating relatively uniformly.

Next, referring to FIGS. 1 through 6, we explain the operating mode (operation) of the flush toilet 1 according to the embodiment of the invention.

Figure 6:
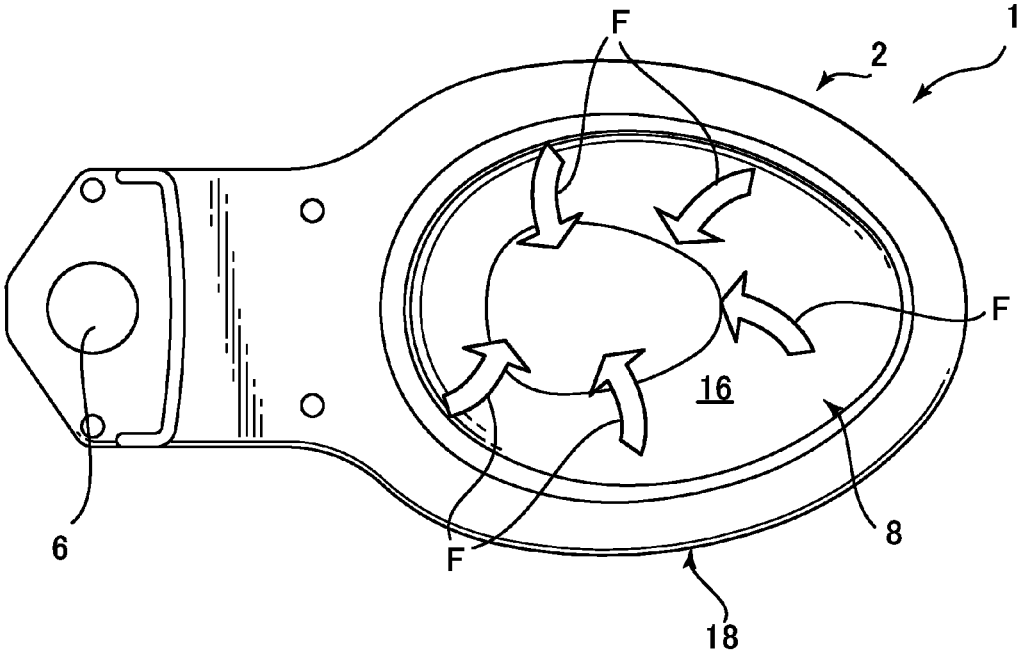
FIG. 6 is a diagram showing an appearance when the flush water flows down as it circulates relatively uniformly over a broader area of the waste receiving surface in the flush toilet according to the embodiment of the invention.

FIG. 6 is a diagram showing the appearance when the flush water flows down as it circulates relatively uniformly over a broad area of the waste receiving surface in the flush toilet according to the embodiment of the invention.

Figure 7:
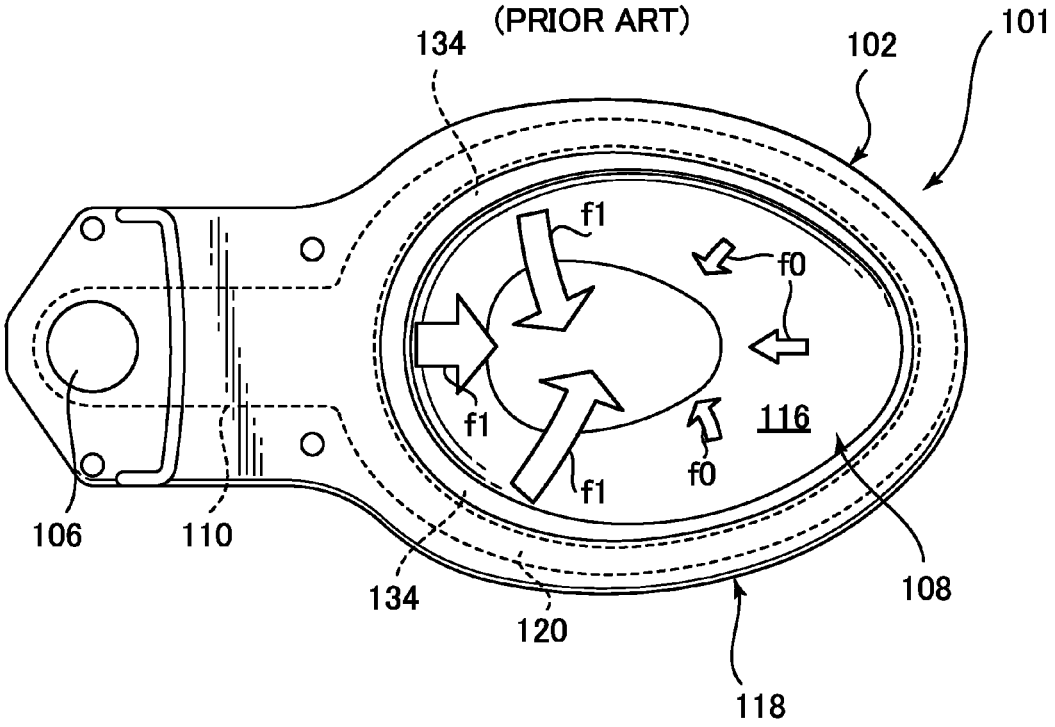
FIG.7 (PRIOR ART)
FIG. 7 is a diagram showing an appearance when a main flow of flush water flows down from a rear side onto a waste receiving surface of a conventional flush toilet.

FIG. 6 shows a main flow f forming a flow circulating over the entire waste-receiving surface 16; the volume and force of the main flow f are shown by the thickness and size of the arrows. The thickness and size of the main flow f arrows in FIG. 6 are essentially the same thickness and size, and are larger in thickness and size than the water flow f0 arrow in FIG. 7 (a diagram explaining the flow of water in a conventional flush toilet).

At first when the operating button (not shown) on the flush operation panel (not shown) for toilet flushing is operated, a discharge valve (not shown) disposed on the storage tank 4 opens, and a predetermined volume of flush water (e.g., 6.0 liters) from the reservoir tank 4 is supplied from the supply port 6 on the back side of the toilet main body 2 to the rim rear water conduit 10.

Next, the flush water flowing into the rim rear water conduit 10 flows within the upstream rim rear water conduit 29, toward the left side. When the flush water reaches the upstream rim water conduit outlet portion 29*a*, the flush water changes direction at the bent portion 32. Specifically, the flush water switches direction from a right-facing flow to a left-facing flow on the toilet main body 2.

The flush water then flows into the downstream rim rear water conduit 31, which extends toward the left front on the opposite side. The flush water follows the downstream rim rear water conduit 31 extending in a straight line, flowing from the downstream rim water conduit inlet portion 31*a* in a straight line toward the downstream rim water conduit outlet portion 31*b*.

The downstream rim rear water conduit 31 is formed to be relatively longer than in the past; flush water passes from the downstream rim water conduit inlet portion 31*a* over the front-to-back center cross section C1 and in a straight line across a relatively long predetermined distance; the direction of flow is relatively uniformly aligned, while flow force is maintained. Therefore spreading of flush water to the left and right from the downstream rim water conduit exit portion 31*b* can be constrained, and the flush water can flow in a straight line along center axis line A2 toward the rim water passage 20.

The flush water flowing out from the downstream rim water conduit outlet portion 31*b* flows into the rim water passage 20 in a direction so as to circulate counter-clockwise in the rim water passage 20. The flush water gradually flows down onto the waste-receiving surface 16 from the slit opening portion 34 formed over the entire circumference as it seeks to circulate the rim water passage 20 in an annular shape.

The flush water flowing into the rim water passage 20 flows from the center area close to the front-to-back center cross section C1 toward the first area X1 on the first side (left side). In the first area X1, the flush water flows in from the connecting water conduit 10*a*, therefore the flush water flow force is the strongest and the water volume is the highest there.

In the first area X1, the flush water which has flowed into the rim water passage 20 flows over the rim passage bottom surface 30 of the rim water passage 20. Here the back end portion 34*a* of the slit opening portion 34 is formed to the size of the slit gap a1, i.e., the slit gap is formed to be extremely small, so that in the area where the flush water flowing in from the connecting water conduit 10*a* can easily flow down, the volume of flush water flowing down onto the waste-receiving surface 16 from the back end portion 34*a* can be constrained to a relatively small volume, and the flow force can also be constrained. Hence splashing of flush water outside the toilet by the downward flow, essentially falling, of the relatively large volume of flush water from the slit opening portion 34 in an upstream portion of the first area X1 onto the reservoir surface along the waste-receiving surface 16 can be constrained.

In the first area X1, the size of the slit gap of the slit opening portion 34 is formed to gradually increase from the back end portion 34*a* (slit gap a1) toward the left side rear portion 34*b* (slit gap a2) and the left side portion 34*c* (slit gap a3).

Therefore the volume of flush water spouted from the slit opening portion 34 is formed to gradually increase from the back end portion 34*a* (slit gap a1) toward the left side rear portion 34*b* (slit gap a) and the left side portion 34*c* (slit gap a3).

As it progresses downstream, the volume of flush water flowing so as to circulate over the rim passage bottom surface 30 in the rim water passage gradually decreases by the amount flowing down from the slit opening portion 34.

The flush water flowing in from the first area X1 to the second area X2 flows forward on the rim passage bottom surface 30 in the rim water passage 20.

In the second area X2, the size of the slit gap of the slit opening portion 34 is formed to gradually increase from the left side portion 34*c* (slit gap a toward the left side front portion 34*d* (slit gap a3) and the front end portion 34*e* (slit gap a5).

Therefore the volume of flush water spouted from the slit opening portion 34 is formed to gradually increase from the left side portion 34*c* (slit gap a3) toward the left side front portion 34*d* (slit gap a4) and the front end portion 34*e* (slit gap a5).

As it progresses downstream, the volume of flush water flowing so as to circulate over the rim passage bottom surface 30 in the rim water passage 20 gradually decreases by the amount flowing down from the slit opening portion 34.

Thus, the volume and force of flush water flowing so as to circulate on the rim passage bottom surface 30 in the rim water passage 20 gradually decreases as it progresses from the upstream to the downstream, in response to which the volume and force of spouted flush water is adjusted so as to gradually increase in the following sequence: the back end portion 34*a* (slit gap a1), the left side rear portion 34*b* (slit gap a2), the left side portion 34*c* (slit gap a3), the left side front portion 34*d* (slit gap a4), and the front end portion 34*e* (slit gap a5). Therefore, from the first area X1 to the second area X2 of the toilet main body 2, the flush water volume and force spouted onto the waste-receiving surface 16 is relatively uniform.

The flush water flows so as to circulate on the rim passage bottom surface 30, and flows in a direction which seeks to turn counter-clockwise, so the flush water spouted from the slit opening portion 34 forms a circulating flow with a relatively uniform volume and force, and flows down over the waste-receiving surface 16.

Additionally, the flush water flowing from the second area X2 into the third area X3 flows over the rim passage bottom surface 30 in the rim water passage 20 from the right side toward the rear side.

In the third area X3, the size of the slit gap of the slit opening portion 34 is formed to be a constant relatively large size from the front end portion 34*e* (slit gap a5) to the right side front portion 34*f* (slit gap a6) and the right side portion 34*g* (slit gap a7). Hence the volume of flush water spouted from the slit opening portion 34 is formed to be a relatively constant volume from the front end portion 34*e* (slit gap a5) to the right side front portion 34*f* (slit gap a6) and the right side portion 34*g* (slit gap a7).

As it progresses from the front end portion of the bowl portion 8 downstream, the volume of flush water flowing so as to circulate over the rim passage bottom surface 30 in the rim water passage 20 gradually decreases by the amount flowing down from the slit opening portion 34.

Thus, in the third area X3, the volume of spouted flush water is adjusted to be a relatively large and also relatively constant water volume in each area from the front end portion 34*e* (slit gap a5) to the right side front portion 34*f* (slit gap a6) and right side portion 34*g* (slit gap a7).

As a result, in an open rim type of flush toilet for circulating the flush water from one side, such as the flush toilet of the present embodiment, even in the third area X3 of the flush toilet, considered to be relatively susceptible to insufficient flush water, the flush water can flush the waste-receiving surface 16 with a relatively large water volume and a relatively strong flow force.

The flush water flows so as to circulate on the rim passage bottom surface 30, and flows in a direction which seeks to turn counter-clockwise, so the flush water spouted from the slit opening portion 34 forms a circulating flow with a relatively uniform volume and force, and flows down over the waste-receiving surface 16.

In the left-right center cross section C2, the slit opening portion 34*c* is formed to be smaller than the slit opening portion 34*g*, so the volume of flush water in the circulating flow spouted onto the waste-receiving surface 16 from the main flow F circulating inside the rim water passage 20 is reduced in the slit opening portion 34*c* on the first side and adjusted so as to be increased in the slit opening portion 34*g* on the second side.

In the left-right rear portion cross section C3, the slit opening portion 34*b* is formed to be smaller than the slit opening portion 34*h*, so the volume of flush water in the circulating flow spouted onto the waste-receiving surface 16 from the main flow F which circulates inside the rim water passage 20, is reduced in the slit opening portion 34*b* and adjusted so as to be increased in the slit opening portion 34*h*.

The flush water flowing from the third area X3 to the fourth area X4 flows rearward on the rim passage bottom surface 30 in the rim water passage 20.

In the fourth area X4, the size of the slit gap of the slit opening portion 34 is formed to gradually decrease from the right side portion 34*g* (slit gap a7) toward the right side rear portion 34*h* (slit gap a8) and the back end portion 34*a* (slit gap a1). Therefore, the volume of flush water spouted from the slit opening portion 34 is formed to gradually decrease from the right side portion 34*g* (slit gap a7) toward the right side rear portion 34*h* (slit gap a8) and the back end portion 34*a* (slit gap a1). As it progresses downstream, the volume of flush water flowing so as to circulate over the rim passage bottom surface 30 in the rim water passage 20 gradually decreases by the amount flowing down from the slit opening portion 34. The flush water which has made a complete revolution over the rim passage bottom surface 30 inside the rim water passage 20 up to the back end portion merges with the flush water newly flowing in from the connecting water conduit 10*a*, and again flows forward from the first area X1.

Thus, in the fourth area X4, an adjustment is made so that the volume of spouted flush water gradually decreases in the order of the right side portion 34*g* (slit gap a7) to the right side rear portion 34*h* (slit gap a8) and the back end portion 34*a* (slit gap a1).

Here, in the fourth area X4, the slit gap of the slit opening portion 34 is formed to decrease at a relatively sudden rate from the a7 size to the a1 size. Hence the volume and force of spouted flush water is kept at a relatively high water volume and force from the right side portion 34*g* (slit gap a7) to even the right side rear portion 34*h* (slit gap a8).

As a result, in an open rim type of flush toilet for circulating the flush water from one side, such as the flush toilet of the present embodiment, even in the fourth area X4 of the flush toilet, considered to be relatively susceptible to insufficient flush water, the flush water can flush the waste-receiving surface 16 with a relatively large water volume and a relatively strong flow force.

In the back end portion 34*a* (slit gap a1), as described above, the slit gap is formed to be extremely small, therefore in areas where the flush water flowing in from the connecting water conduit 10*a* is prone to flow down, the volume flowing down from the back end portion 34*a* on the waste-receiving surface 16 can be constrained to a relatively small volume. Hence even in the fourth area X4, the volume and force of flush water spouted to the waste-receiving surface 16 is a relatively uniform volume of water and force, and a circulating flow in which the flush water has a relatively uniform water volume and force can be formed and caused to flow down on the waste-receiving surface 16.

The percentage change in the size of the gradually expanding slit gaps in the slit opening portions 34*a*, 34*b*, and 34*c* in the first area X1 is smaller than the percentage change in the size of the slit gaps in the gradually expanding slit opening portions 34*a*, 34*h*, and 34*g* in the fourth area X4. Therefore, the percentage change in the size of the flush water volumes spouted from the slit opening portion 34 is adjusted. For example, the percentage change in the size by which the slit gaps of the slit opening portion 34*a*, 34*b*, and 34*c* gradually increase in the first area X1 is relatively small, so the percentage by which the volume of water spouted from the slit opening portion 34 increases going from the slit gap of the slit opening portion 34*a* to the slit gap of the slit opening portion 34*c* can be constrained to a relatively low percentage. On the other hand, in the fourth area X4, for example, the percentage change in the size to which the slit opening portions 34*a*, 34*h*, and 34*g* increase is relatively large (i.e., the percentage change in the sizes to which the slit gaps gradually decrease when viewed in the slit gap opening portion sequence 34*g*, 34*h*, and 34*a* is relatively large), so the percentage reduction in the volume of water spouted from the slit opening portion 34 between the slit opening portion 34*g* and the slit opening portion 34*a* is relatively high. Since the slit gap of the slit opening portion 34 changes suddenly in the fourth area X4, the volume of water spouted from the vicinity of the slit opening portion 34*a* is held down to a relatively small volume compared to the large volume of water spouted from the vicinity of the slit opening portions 34*h* and 34*g*. Thus, even in the fourth area X4, the spouted water volume can be adjusted to form a circulating flow for flushing over the entire waste-receiving surface 16 while circulating relatively uniformly.

Thus, as shown in FIG. 6, a main flow f of flush water with a relatively uniform water volume and force is spouted onto the waste-receiving surface 16, and a circulating flow with a relatively uniform water volume and force can be formed, even in any of the first area X1, second area X2, third area X3, and fourth area X4. As shown in FIG. 6, the waste-receiving surface 16 can be flushed using a flush water main flow f which circulates relatively widely and uniformly over the entire waste-receiving surface 16. Therefore, in an open rim-type flush toilet such as the flush toilet of the present embodiment, a circulating flow with a relatively uniform water volume and force can be formed on the waste-receiving surface 16, flushing can be carried out over a wide area of the waste-receiving surface 16, and incomplete flushing of waste can be constrained, improving the waste-receiving surface 16 flushing capability.

The flush water flushes the entire waste-receiving surface 16 of the bowl portion 8, while forming the above type of circulating flow. The flush water flowing down the bowl portion 8 is discharged from the discharge trap pipe 14 together with waste, thereby completing one sequence of the toilet main body 2 flushing operation.

Using the flush toilet 1 according to the above-described embodiment of the invention, the slit opening portion 34 is formed such that the slit gap of the slit opening portion 34 on the first side is smaller than the slit gap of the slit opening portion 34 on the second side being the other of the left and right sides relative to the front-to-back center cross section C1. Therefore a circulating flow can be formed to flush over the entire waste receiving surface 16 while circulating relatively uniformly by adjusting the volume of the flush water spouted from the slit opening portion 34 forming the different slit gaps, so as to reduce on the slit opening portion 34 on the first side as well as increase on the slit opening portion 34 on the second side, the volume of circulating flush water spouted onto the waste receiving surface 16 from the main flow which circulates within the rim passage 20 from the side to which the connecting water conduit 10*a* of the rim rear water conduit 10 is directed. It is also possible to constrain flush water from flowing down along the waste receiving surface 16, so as to essentially drop down from the upstream-side slit opening portion 34 on the first side, and thereby to constrain splashing of flush water to outside the toilet.

Since parts of the waste receiving surface 16 with low visibility to the user to see are formed with left-right symmetry, and the rim inside wall, which is easily visible to the user, is formed with left-right symmetry, local changes in the external appearance of the toilet main body 2 can be constrained and an impression of the external appearance with left-right symmetry can be conveyed to the user, so that design characteristics are favorably preserved.

Also, using the flush toilet 1 according to the present embodiment, the volume of flush water spouted from the slit opening portion 34 forming different slit gaps can be adjusted so that the volume of the circulating flush water flow spouted onto the waste receiving surface 16 from a main flow circulating inside the rim passage 20 is increased in the expanded slit gap portion 34*i* disposed on the front side of the toilet main body 2, and a circulating flow can be formed to flush over the entire waste receiving surface 16 as it circulates relatively uniformly.

Furthermore, using the flush toilet 1 of the present embodiment, on the first side where the connecting water conduit 10*a* of the rim rear water conduit 10 is directed, the slit gap may be formed to be relatively small in the back end portion 34*a* of the rim portion 18 where the flow force is strongest and the volume of water is large, and may be formed to gradually increase from the back end portion 34*a* of the rim portion 18 to the first side portion 34*c* of the rim portion 18 as the flow force gradually weakens and the volume of water gradually decreases. Therefore by adjusting the volume of water in the circulating flush water flow spouted from a main flow circulating in the rim passage 20 onto the waste receiving surface 16 so that the volume of spouted flush water is gradually increased in the slit opening portion 34 from the back end portion up to the first side portion on the first side rim portion, a circulating flow can be formed which flushes the entire waste receiving surface 16 as it circulates relatively uniformly.

Using the flush toilet 1 of the present embodiment, in the left-right center cross section C2 of the bowl portion 8, by adjusting the flush water volume spouted from slit opening portions 34 of differing slit gaps so that the volume of circulating flush water flow spouted onto the waste receiving surface 16 from a main flow F circulating in the rim water passage 20 is reduced in the slit opening portion 34*c* on the first side and increased in the slit opening portion 34*g* on the second side, a circulating flow can be formed which flushes the entire waste receiving surface 16 while circulating relatively uniformly.

Using the flush toilet 1 of the present embodiment, in the left-right cross section C3 in the rear portion of the bowl portion 8, by adjusting the flush water volume spouted from slit opening portion 34 forming different slit gaps so that the volume of circulating flush water flow spouted onto the waste receiving surface 16 from a main flow F circulating in the rim water passage 20 is reduced in the slit opening portion 34*b* on the first side and increased in the slit opening portion 34*h* on the second side, a circulating flow can be formed which flushes the entire waste receiving surface 16 while circulating relatively uniformly.

Using the flush toilet 1 of the present embodiment, on the first side where the flush flow force from the rim rear water conduit 10 is relatively strong, the change percentage by which the slit gap gradually increases from the back end portion 34*a* to the first side portion 34*c* of the rim portion 18 is small, and the volume of the circulating flush water flow spouted onto the waste-receiving surface 16 from the main flow F circulating in the rim water passage 20 is constrained so that it has difficulty increasing in the slit opening portion 34 on the first side, where flow force is relatively strong.

On the other hand, on the second side where the flush water primarily circulating in the rim water passage 20 reaches and the flow force becomes relatively weak, the change percentage is relatively large so that the slit gap gradually increases from the back end portion 34*a* of the rim portion 19 to the second side portion 34*g* of the rim portion 18. Therefore the volume of circulating flush water flow spouted onto the waste-receiving surface 16 from the main flow circulating in the rim water passage 20 is made difficult to reduce, even in the vicinity of the back end portion of the slit opening portion 34 on the second side, where the flow force becomes relatively weak.

The percentage change in the volume of the flush water spouted from the slit opening portion 34 can be adjusted by making the percentage change to the size of the slit gap on the first side different from the percentage change to the size of the slit gap on the second side, and a circulating flow can be formed to flush the entire waste-receiving surface 16 while circulating relatively uniformly.

Also, using the flush toilet 1 of the present embodiment, on the first side, the slit gap may be formed to be relatively small in the back end portion 34*a* of the rim passage 20 where the flow force is strongest and the volume of water is large, and may be formed to gradually increase from the back end portion 34*a* of the rim portion 18 to the front end portion 34*e* of the rim portion 18 as the flow force gradually weakens and the volume of water gradually decreases. Therefore by adjusting the volume of circulating flush water flow spouted onto the waste-receiving surface 16 from the main flow F circulating in the rim water passage 20 to gradually increase using gradually larger slit gap, a circulating flow can be formed which flushes the entire waste receiving surface 16 as it circulates relatively uniformly.

By using the flush toilet 1 of the present embodiment, by using the connecting portion 36 to connect between the upper edge portion 16*a* of the waste receiving surface 16 and the rim inside wall 26, the size of slits formed between the upper edge portion 16*a* of the waste receiving surface 16 and the rim inside wall 26 can be relatively easily manufactured to specification. Therefore when forming the slit gap, increases in the cost of overseeing inspection, adjustment, and modifications, etc. of the slit gap size, and by extension the manufacturing cost, can be constrained.

Using the flush toilet 1 of the present embodiment, the rim portion 18 is formed so that the width W1 of the rim portion 18 on the first side is the same as the width W1 of the rim portion 18 on the second side, therefore the rim portion 18 width T1 visible to the user is formed with left-right symmetry. Therefore, localized changes in the external appearance of the toilet main body 2 can be constrained, a left-right symmetrical external shape can be formed, and design characteristics can be favorably preserved.

What is claimed is:

1. A flush toilet for flushing a toilet main body with flush water, comprising:

a water supply apparatus for supplying the flush water to a supply port of the toilet main body;

a bowl portion having a bowl-shaped waste receiving surface and a rim portion provided on or above an upper edge portion of the bowl-shaped waste receiving surface, the rim portion forming a rim passage for guiding the flush water to an inner part, the upper edge portion of the bowl-shaped waste receiving surface being formed to be left-right asymmetrical relative to a front-to-back center cross section;

a discharge path connected to a bottom portion of the bowl portion for discharging waste together with the flush water; and a rim rear water conduit extending forward from the supply port, the rim rear water conduit including a connecting water conduit connected to the rim passage, the connecting water conduit being directed to the rim passage on a first side that is one of left and right sides relative to the front-to-back center cross section of the toilet main body;

wherein the rim portion includes:

a rim inside wall formed to be left-right symmetrical relative to the front-to-back center cross section; and a slit opening portion formed between the upper edge portion of the bowl-shaped waste receiving surface and the rim inside wall;

wherein the slit opening portion is formed in such a manner that a slit gap of the slit opening portion on the first side is smaller than a slit gap of the slit opening portion on a second side being the other of the left and right sides relative to the front-to-back center cross section, thereby a circulating flow is formed on the waste receiving surface by the flush water spouted from the slit opening portion; and wherein the slit opening portion is formed in such a manner that the slit gap of the slit opening portion on the first side is smaller than the slit gap on the slit opening portion on the second side in a cross section perpendicular to the front-to-back direction in a middle portion in the front-to-back direction of the bowl portion.

2. The flush toilet according to claim 1, further comprising a connecting portion provided between the upper edge portion of the waste receiving surface and the rim inside wall.

3. The flush toilet according to claim 1, wherein the rim portion is formed in such a manner that a width of the rim portion on the first side is equal to a width of the rim portion on the second side.

4. The flush toilet according to claim 1, wherein the slit opening portion is formed in such a manner that an expanded slit gap portion is formed in a part of a front region of the toilet main body, a slit gap in the expanded slit gap portion being larger than the slit gap of the slit opening portion on the first side and equal to or larger than the slit gap of the slit opening portion on the second side.

5. A flush toilet for flushing a toilet main body with flush water, comprising:

a water supply apparatus for supplying the flush water to a supply port of the toilet main body;

a bowl portion having a bowl-shaped waste receiving surface and a rim portion provided on or above an upper edge portion of the bowl-shaped waste receiving surface, the rim portion forming a rim passage for guiding the flush water to an inner part, the upper edge portion of the bowl-shaped waste receiving surface being formed to be left-right asymmetrical relative to a front-to-back center cross section;

a discharge path connected to a bottom portion of the bowl portion for discharging waste together with the flush water; and a rim rear water conduit extending forward from the supply port, the rim rear water conduit including a connecting water conduit connected to the rim passage, the connecting water conduit being directed to the rim passage on a first side that is one of left and right sides relative to the front-to-back center cross section of the toilet main body;

wherein the rim portion includes a rim inside wall formed to be left-right symmetrical relative to the front-to-back center cross section; and a slit opening portion formed between the upper edge portion of the bowl-shaped waste receiving surface and the rim inside wall;

wherein the slit opening portion is formed in such a manner that a slit gap of the slit opening portion on the first side is smaller than a slit gap of the slit opening portion on a second side being the other of the left and right sides relative to the front-to-back center cross section, thereby a circulating flow is formed on the waste receiving surface by the flush water spouted from the slit opening portion; and wherein the slit opening portion is formed in such a manner that the slit gap of the slit opening portion on the first side is smaller than the slit gap on the slit opening portion on the second side in a cross section perpendicular to the front-to-back direction in a rear portion in the front-to-back direction of the bowl portion.

6. The flush toilet according to claim 5, wherein the slit opening portion is formed in such a manner that an expanded slit gap portion is formed in a part of a front region of the toilet main body, a slit gap in the expanded slit gap portion being larger than the slit gap of the slit opening portion on the first side and equal to or larger than the slit gap of the slit opening portion on the second side.

7. The flush toilet according to claim 5, further comprising a connecting portion provided between the upper edge portion of the waste receiving surface and the rim inside wall.

8. The flush toilet according to claim 5, wherein the rim portion is formed in such a manner that a width of the rim portion on the first side is equal to a width of the rim portion on the second side.

9. A flush toilet for flushing a toilet main body with flush water, comprising:

a water supply apparatus for supplying the flush water to a supply port of the toilet main body;

a bowl portion having a bowl-shaped waste receiving surface and a rim portion provided on or above an upper edge portion of the bowl-shaped waste receiving surface, the rim portion forming a rim passage for guiding the flush water to an inner part, the upper edge portion of the bowl-shaped waste receiving surface being formed to be left-right asymmetrical relative to a front-to-back center cross section;

a discharge path connected to a bottom portion of the bowl portion for discharging waste together with the flush water; and a rim rear water conduit extending forward from the supply port, the rim rear water conduit including a connecting water conduit connected to the rim passage, the connecting water conduit being directed to the rim passage on a first side that is one of left and right sides relative to the front-to-back center cross section of the toilet main body;

wherein the rim portion includes a rim inside wall formed to be left-right symmetrical relative to the front-to-back center cross section; and a slit opening portion formed between the upper edge portion of the bowl-shaped waste receiving surface and the rim inside wall;

wherein the slit opening portion is formed in such a manner that a slit gap of the slit opening portion on the first side is smaller than a slit gap of the slit opening portion on a second side being the other of the left and right sides relative to the front-to-back center cross section, thereby a circulating flow is formed on the waste receiving surface by the flush water spouted from the slit opening portion; and wherein the slit opening portion is formed in such a manner that a rate of change of the slit gap of the slit opening portion on the first side gradually increasing from a back end portion of the rim portion to a portion on the first side of the rim portion is smaller than a rate of change of the slit gap of the slit opening portion on the second side gradually increasing from the back end portion of the rim portion to a portion on the second side of the rim portion.

10. The flush toilet according to claim 9, wherein the slit opening portion is formed in such a manner that a slit gap of the slit opening portion on the first side gradually increases from a back end portion of the rim portion to a front end portion of the rim portion.

11. The flush toilet according to claim 9, wherein the slit opening portion is formed in such a manner that an expanded slit gap portion is formed in a part of a front region of the toilet main body, a slit gap in the expanded slit gap portion being larger than the slit gap of the slit opening portion on the first side and equal to or larger than the slit gap of the slit opening portion on the second side.

12. The flush toilet according to claim 9, further comprising a connecting portion provided between the upper edge portion of the waste receiving surface and the rim inside wall.

13. The flush toilet according to claim 9, wherein the rim portion is formed in such a manner that a width of the rim portion on the first side is equal to a width of the rim portion on the second side.

* * * * *